US008052478B2

(12) United States Patent
Zhu

(10) Patent No.: US 8,052,478 B2
(45) Date of Patent: Nov. 8, 2011

(54) ELECTRICAL CONNECTOR WITH A SOLDERING PORTION OF A HALF-BALL SHAPED

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/831,286

(22) Filed: Jul. 7, 2010

(65) Prior Publication Data

US 2011/0124235 A1 May 26, 2011

(30) Foreign Application Priority Data

Nov. 20, 2009 (CN) ..... 2009 2 0315305

(51) Int. Cl.
*H01R 24/00* (2011.01)

(52) U.S. Cl. ..... 439/660

(58) Field of Classification Search ..... 439/660, 439/682, 862

See application file for complete search history.

(56) References Cited

U.S. PATENT DOCUMENTS 4,193,660 A * 3/1980 Jaconette ..... 439/752
5,338,231 A * 8/1994 Wilhite ..... 439/660
6,398,598 B2 * 6/2002 Masumoto ..... 439/862
6,409,529 B1 * 6/2002 Liu et al. ..... 439/188
6,447,338 B1 * 9/2002 Bricaud et al. ..... 439/630
6,454,607 B2 * 9/2002 Bricaud ..... 439/630
6,551,143 B2 * 4/2003 Tanaka et al. ..... 439/682
6,702,621 B2 * 3/2004 Yeh ..... 439/660
6,758,702 B2 * 7/2004 Johnescu ..... 439/862
6,814,586 B1 * 11/2004 Ju ..... 439/66
6,843,688 B2 * 1/2005 Matsunaga et al. ..... 439/630
6,951,488 B2 * 10/2005 Hsieh ..... 439/660
6,994,566 B2 * 2/2006 You ..... 439/66
7,037,113 B2 * 5/2006 Soh ..... 439/66
7,121,848 B2 * 10/2006 Ono ..... 439/83
7,153,173 B2 * 12/2006 Harasawa et al. ..... 439/862
7,278,892 B1 * 10/2007 Chien et al. ..... 439/862
7,387,541 B1 * 6/2008 Lai et al. ..... 439/660
7,510,444 B2 * 3/2009 Chang et al. ..... 439/630
7,517,261 B2 * 4/2009 Wan et al. ..... 439/862
7,553,168 B2 * 6/2009 Zhu et al. ..... 439/74
7,575,469 B1 * 8/2009 Hung ..... 439/500
7,658,658 B2 * 2/2010 Zhu ..... 439/862
7,878,859 B2 * 2/2011 Zhu ..... 439/638
2001/0021609 A1 * 9/2001 Chiang ..... 439/682
2003/0216070 A1 * 11/2003 Yeh ..... 439/131

(Continued)

*Primary Examiner* — Tulsidas C Patel
*Assistant Examiner* — Vladimir Imas
(74) *Attorney, Agent, or Firm* — Wei Te Chung; Andrew C. Cheng; Ming Chieh Chang

(57) ABSTRACT

An electrical connector includes an insulative housing and a plurality of contacts assembled in the insulative housing. The insulative housing defines a mating face and a mounting face opposite to the mating face. A plurality of receiving passageways are extending through the mating face and the mounting face to form a first opening and a second opening. The contacts are assembled in the receiving passageways from the second opening. Each contact defines a base portion of a plate shaped retained in the second opening by a pair of barbs at two opposite first and second sides of the base portion and a pair of elastic arms extending from two opposite third and fourth sides of the base portion to the receiving passageway. The base portion protrudes a soldering portion of a half-ball shaped from an inside face facing the first opening to an outside face opposite to the inside face.

14 Claims, 4 Drawing Sheets

U.S. PATENT DOCUMENTS

2003/0228804 A1* 12/2003 Zhao ..... 439/660
2004/0161979 A1* 8/2004 Kyowski et al. ..... 439/660
2005/0042935 A1* 2/2005 Larsen ..... 439/751
2007/0232102 A1* 10/2007 Huang et al. ..... 439/166
2008/0220660 A1* 9/2008 Zhu et al. ..... 439/709
2009/0023346 A1* 1/2009 Zhu ..... 439/751
2010/0136850 A1* 6/2010 Inaba et al. ..... 439/733.1

* cited by examiner

ELECTRICAL CONNECTOR WITH A SOLDERING PORTION OF A HALF-BALL SHAPED

BACKGROUND OF THE INVENTION

1. Field of the Invention

The present invention relates to an electrical connector, and more particularly to an electrical connector having contacts with soldering portions of a half-ball shaped through which the contacts are welded to a PCB.

2. Description of the Related Art

A traditional electrical connector comprises an insulative housing and a plurality of contacts received in the insulative housing. Each contact includes a contacting portion mating with a mating connector, a retaining portion by which the electrical connector is retained in the insulative housing and a soldering portion welded to a PCB (Print Circuit Board). The traditional soldering portion extends levelly along the mounting face or vertically. The said soldering portion might be welded to the PCB badly and occupy a big space on the PCB.

In view of the above, a new electrical connector that overcomes the above-mentioned disadvantages is desired.

SUMMARY OF THE INVENTION

Accordingly, an object of the present invention is to provide an electrical connector.

To fulfill the above-mentioned object, an electrical connector comprises an insulative housing and a plurality of contacts assembled in the insulative housing. The insulative housing defines a mating face and a mounting face opposite to the mating face. A plurality of receiving passageways are extending through the mating face and the mounting face to form a first opening and a second opening. The contacts are assembled in the receiving passageways from the second opening. Each contact defines a base portion of a plate shaped retained in the second opening by a pair of barbs at two opposite first and second sides of the base portion and a pair of elastic arms extending from two opposite third and fourth sides of the base portion to the receiving passageway. The base portion protrudes a soldering portion of a half-ball shaped from an inside face facing the first opening to an outside face opposite to the inside face.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
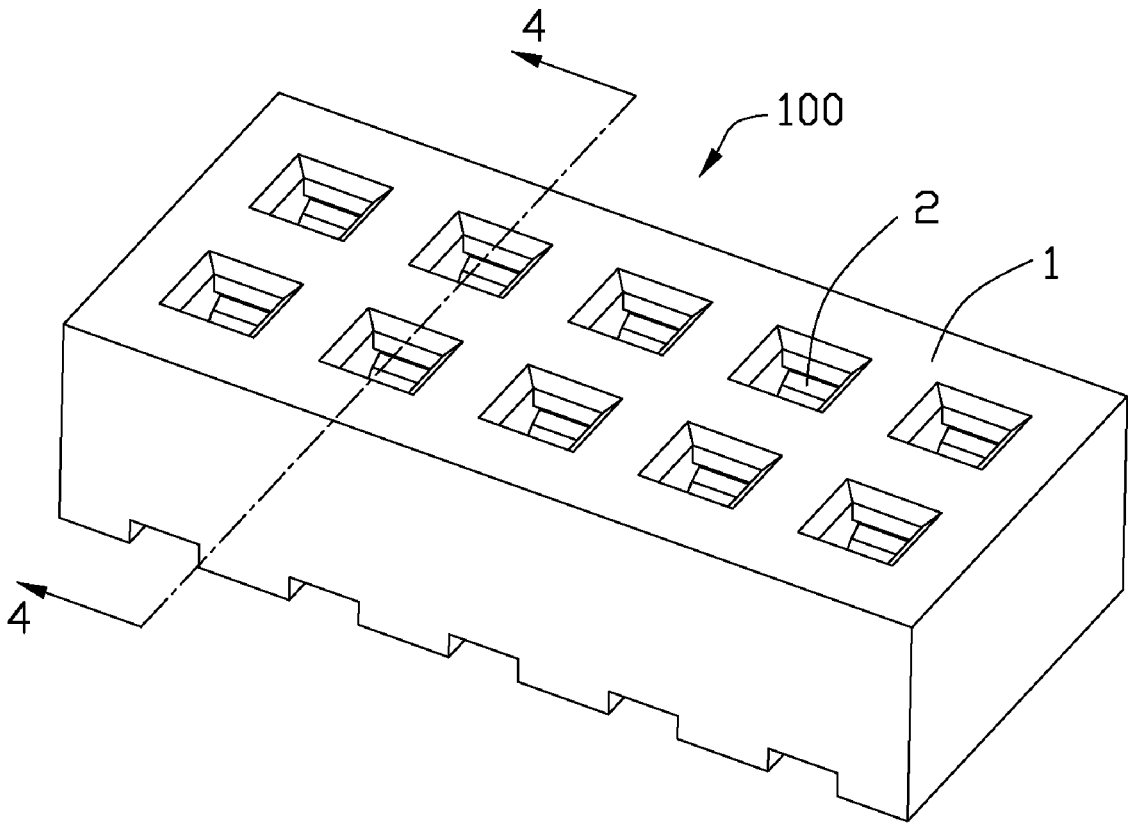
FIG. 1 is a top perspective view of an electrical connector of the present invention.
Figure 2:
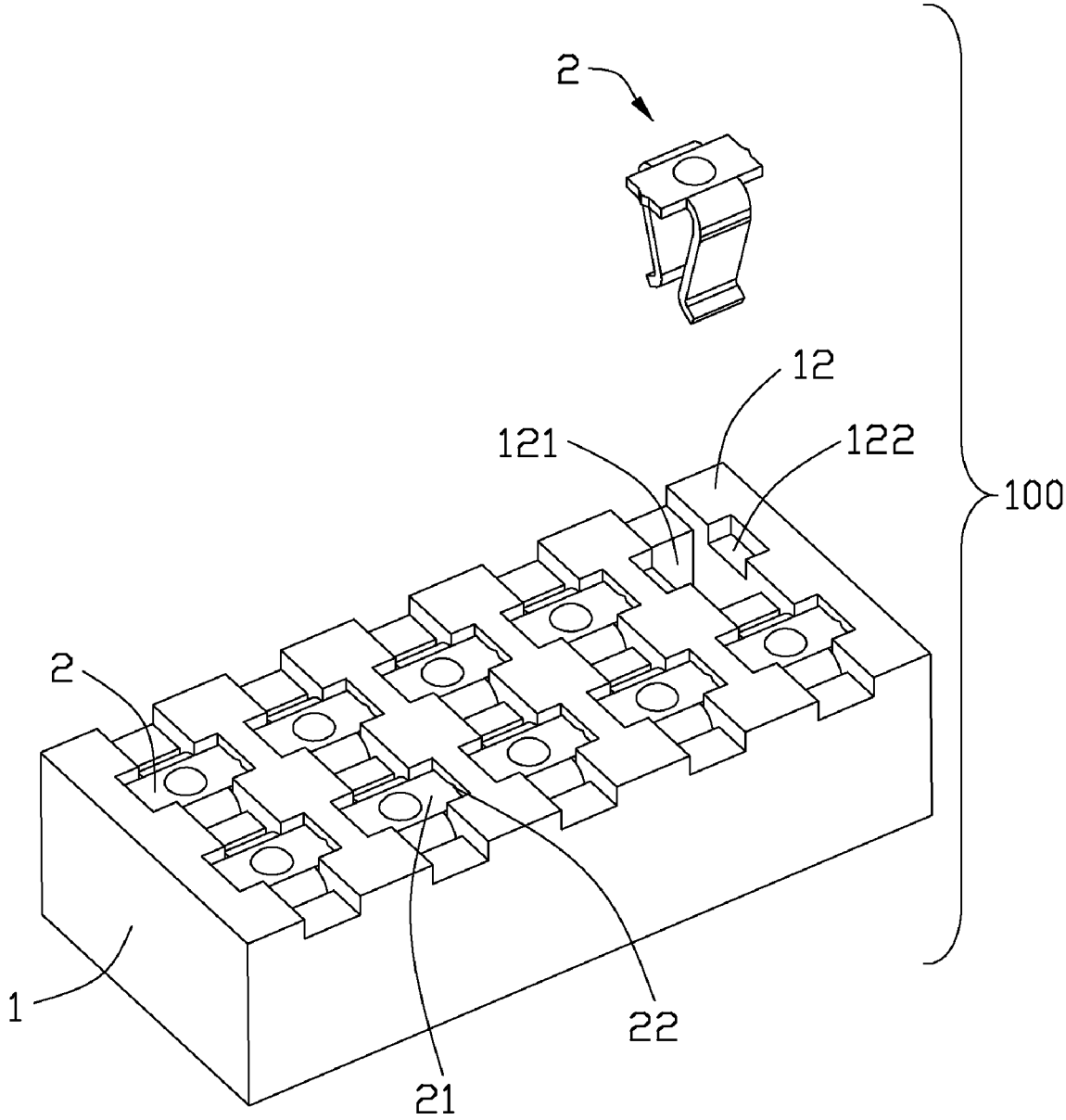
FIG. 2 is a bottom perspective view of the electrical connector of FIG. 1 with a contact taken out of an insulative housing.

Referring to FIGS. 1-2, an electrical connector 100 includes a rectangle insulative housing 1 and a plurality of contacts 2 assembled in the insulative housing 1.

Figure 3:
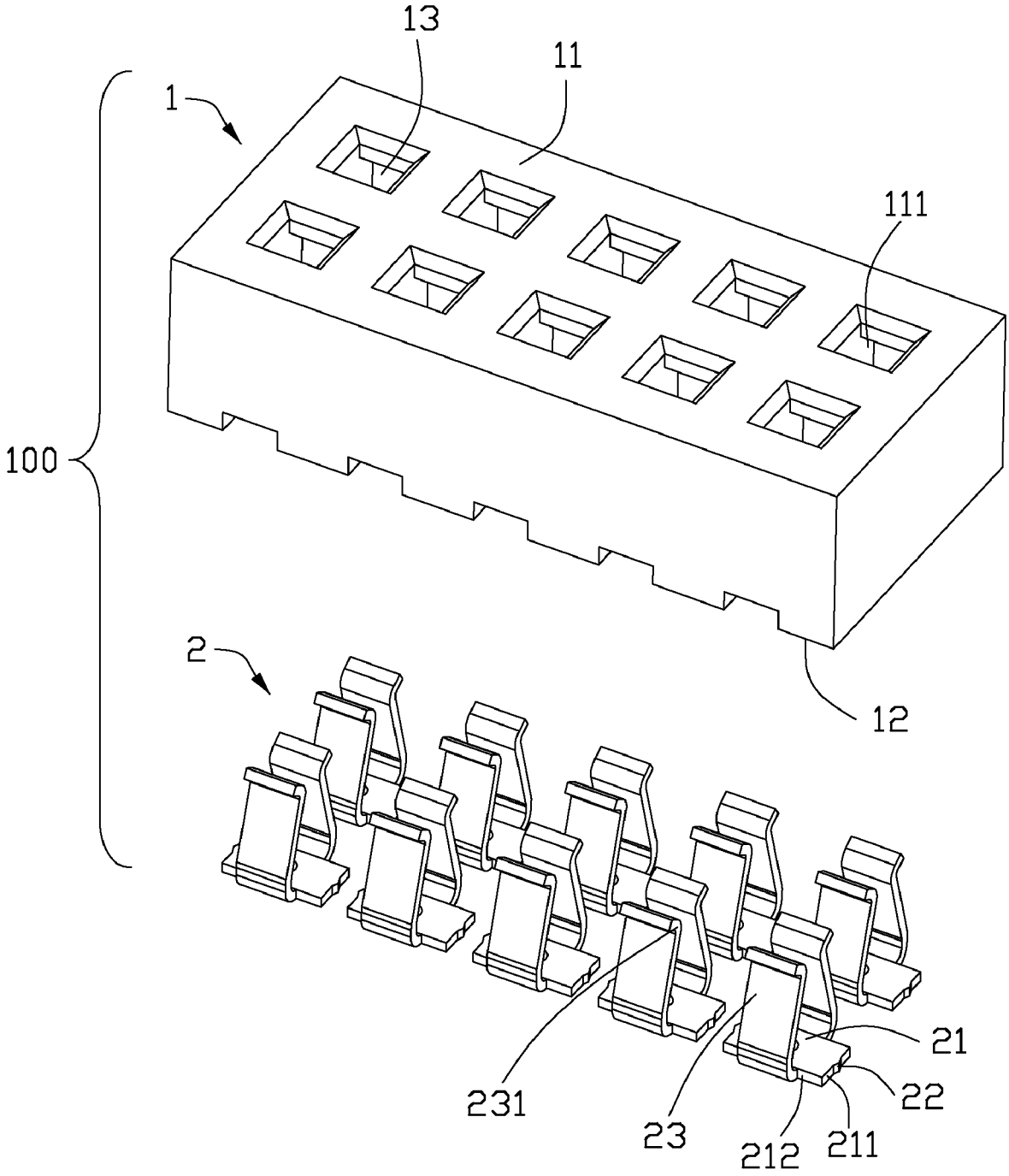
FIG. 3 is an exploded view of the electrical connector of FIG. 1.

Referring to FIG. 3, the insulative housing 1 defines a top mating face 11, a bottom mounting face 12 opposite to the mating face 11 and a plurality of receiving passageways 13 extending through the housing 1 and communicating with an exterior through the mating face 11 and the mounting face 12. The receiving passageways 13 are arranged symmetrically in two rows.

Figure 4:
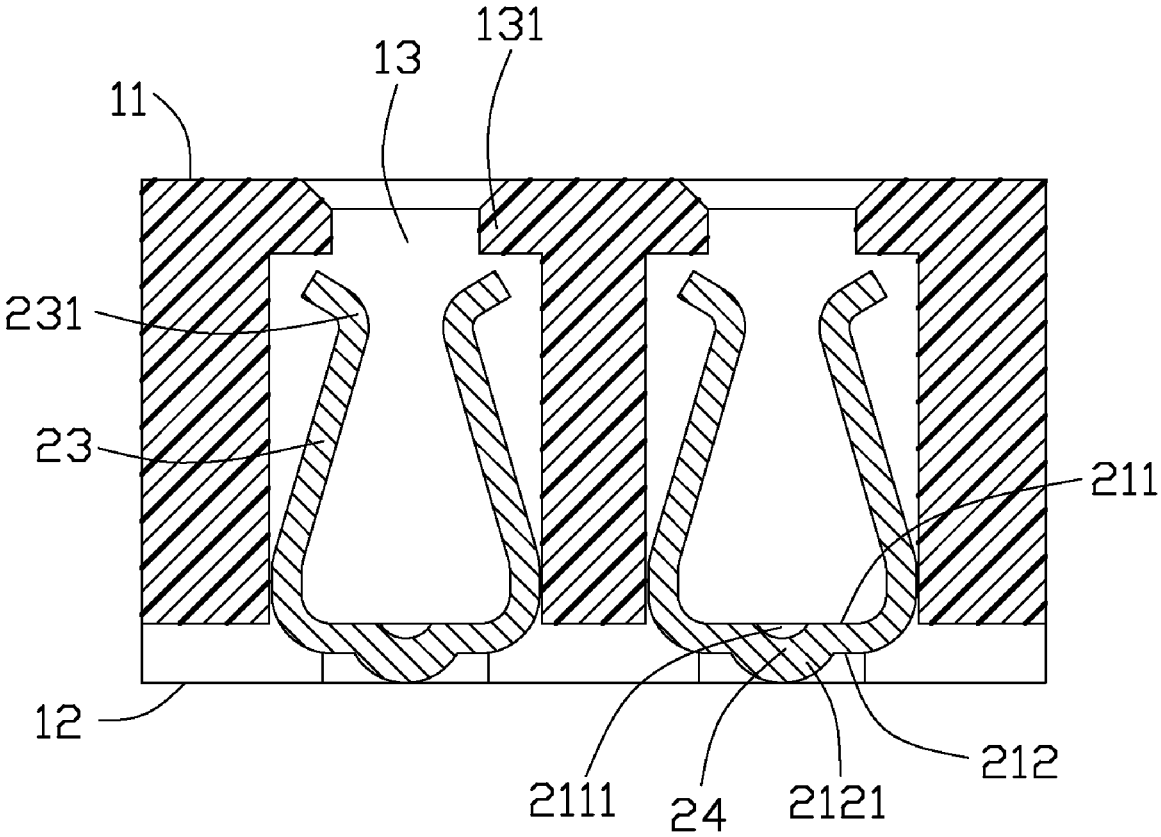
FIG. 4 is a cross sectional view of the electrical connector taken along 4-4 in FIG. 1.

The contacts 2 are assembled in the receiving passageways 13 in a downward-to-upward direction. Each contact 2 is configured with a U-shaped manner and includes a base portion 21 of a plate shaped with a pair of barbs 22 projecting from two opposite first and second sides 211 of the base portion 21 and a pair of elastic arms 23 extending from two opposite third and fourth sides 212 of the base portion 21. Referring to FIGS. 2-3, each receiving passageway 13 runs through the mating face 11 and the mounting face 12 to form a first opening 111 and a second opening 121. The contacts 2 are inserted into the insulative housing 1 from the second openings 121. The mating face 12 further forms a pair of retaining grooves 122 on two opposite sides of the second openings 121 and communicating with the second openings 121. The base portions 21 are retained in the second openings 121 and the retaining grooves 122 by the pairs of barbs 22 interference with the inner walls of the retaining grooves 122 to retain the contacts 2 in the insulative housing 1. The base portions 21 are dimensioned as larger to shut the second openings 212. The pairs of elastic arms 23 extend upwards through the receiving passageways 13 and each pair of elastic arms 23 defines a pair of contacting points 231 facing to each other. Referring to FIG. 4, each receiving passageway 13 further defines a pair of nose portions 131 projecting to each other from the mating face 11. The pairs of nose portions 131 are just above the pairs of elastic arms 23 to prevent the contacts 2 out of the receiving passageways 13. The contacting points 231 protrude beyond the nose portions 131.

Referring to FIG. 4, each base portion 21 defines an inside face 211 facing the first opening 111 and an outside face 212 opposite to the inner face 211. The base portion 21 further define a soldering portion 24 of a half-ball shaped formed by punching the base portion 21 from the inside face 211 to the outside face 212 so that the inner side 211 is configured with a groove 2111 and the outside face 212 is configured with a tuber 2121. The groove 2111 is at the center of the soldering portion 24. The radius of the groove 2111 is smaller than the radius of the tuber 2121. The soldering portions 24 are planar with the mounting face 12 at bottom tips of the soldering portions 24 and located below the insulative housing 1. When the electrical connector 100 is welded to a PCB, the soldering portions will not occupy a level area of the PCB and be secured to the PCB well.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a mating face and a mounting face opposite to the mating face, a plurality of receiving passageways extending through the mating face and the mounting face to form a first opening and a second opening;

a plurality of contacts assembled in the receiving passageways from the second opening and each contact defining a base portion of a plate shaped retained in the second opening by a pair of barbs at two opposite first and second sides of the base portion and a pair of elastic arms extending from two opposite third and fourth sides of the base portion to the first opening in the receiving passageway; wherein the base portion protrudes a soldering portion of a half-ball shaped from an inside face facing the first opening to an outside face opposite to the inside face.

2. The electrical connector as claimed in claim 1, wherein the soldering portion is formed with a groove in the inside face and a tuber in the outside face of the base portion.

3. The electrical connector as claimed in claim 2, wherein the groove is smaller than the tuber radius thereof.

4. The electrical connector as claimed in claim 3, wherein the mounting face further defines a pair of retaining grooves at two opposite sides of the second opening and communicating with the second openings, the base portion retained in the second opening and the retaining grooves by the pair of barbs interference with the inner walls of the retaining grooves.

5. The electrical connector as claimed in claim 4, wherein the base portion shut the second opening.

6. The electrical connector as claimed in claim 1, wherein the contact is configured with a U-shaped manner.

7. The electrical connector as claimed in claim 6, wherein the soldering portions are planar with the mounting face at bottom tips thereof.

8. The electrical connector as claimed in claim 7, wherein each first opening defines a pair of nose portion above the pair of elastic arms and the elastic arms defines contacting points face to each other in a first direction and protruding beyond the nose portions in the first direction.

9. An electrical connector, comprising:

an insulative housing defining a plurality of receiving passageways extending through the insulative housing;

a plurality of U-shaped contacts received in the receiving passageways and each contact defining a plate base portion and a pair of elastic arms extending from two opposite sides of the base portion, the base portion retained in the receiving passageway by a pair of barbs at another two opposite sides; wherein the base portion is punched with a soldering portion, a bottom tip of the soldering portion is planar with a bottom face of the insulative housing and the base portion is higher than the bottom face of the insulative housing.

10. A low profile electrical connector comprising:

an insulative housing defining opposite top and bottom surfaces;

a plurality of passageways defined in the housing and extending through both said top and bottom surfaces; and a plurality of contacts disposed in the corresponding passageways, respectively, each of said contacts defining a horizontal base portion with two opposite wings retained within corresponding pair of first recesses formed in the bottom surfaces and located by two sides of the corresponding passageway, and a pair of elastic arms upwardly extending from two opposite sides of the base portion in the corresponding passageway; wherein the pair of wings and the pair of elastic arms commonly form a cross like configuration in a top view, and a downwardly protrusion is formed on a center of said cross like configuration for soldering to a printed circuit board.

11. The low profile electrical connector as claimed in claim 10, wherein each of said pair of wings is equipped with barbs on an outer edges for interfering with a side face of the housing in the corresponding recess.

12. The low profile electrical connector as claimed in claim 10, wherein a second pair of recesses are formed in the bottom surface by other two sides of each of said passageways, and are essentially perpendicular to the first pair of recesses in said top view.

13. The low profile electrical connector as claimed in claim 10, wherein each of said passageways is essentially covered by the base portion and a root portion of each corresponding elastic arms around the bottom surface.

14. The lower profile electrical connector as claimed in claim 10 wherein said wings are coplanar with the base portion.

* * * * *